US005847338A

United States Patent [19]

Kuki et al.

[11] Patent Number: 5,847,338

[45] Date of Patent: Dec. 8, 1998

[54] BREAKER DEVICE

[75] Inventors: Heiji Kuki; Kazumoto Konda; Tsutomu Tanaka; Kunihiko Watanabe, all of Yokkaichi, Japan

[73] Assignee: Sumitomo Wiring Systems, Ltd., Japan

[21] Appl. No.: 800,222

[22] Filed: Feb. 12, 1997

[30] Foreign Application Priority Data

| | | | |
|---|---|---|---|
| Feb. 15, 1996 | [JP] | Japan | 8-027801 |
| Mar. 29, 1996 | [JP] | Japan | 8-077133 |
| Apr. 17, 1996 | [JP] | Japan | 8-095736 |
| Nov. 14, 1996 | [JP] | Japan | 8-303358 |

[51] Int. Cl.[6] ..... H01H 3/00; H01H 15/00

[52] U.S. Cl. ..... 200/17 R; 200/16 E

[58] Field of Search ..... 200/1 R, 1 V, 200/5 R, 16 B, 16 E, 17 R, 18

[56] References Cited

U.S. PATENT DOCUMENTS

| | | | |
|---|---|---|---|
| 2,000,231 | 5/1935 | Hepler | 200/16 E |
| 3,187,120 | 6/1965 | Akst | 200/16 E X |
| 3,280,275 | 10/1966 | Sheffield et al. | 200/16 E |
| 3,315,057 | 4/1967 | Geltner | 200/1 V |
| 3,346,710 | 10/1967 | Weston et al. | 200/554 X |
| 4,563,549 | 1/1986 | Lycan | 200/1 V |
| 4,639,558 | 1/1987 | Lycan | 200/16 E X |
| 4,737,603 | 4/1988 | Lycan | 200/18 |

FOREIGN PATENT DOCUMENTS

| | | |
|---|---|---|
| 6-310227 | 11/1994 | Japan . |
| 6-327123 | 11/1994 | Japan . |

*Primary Examiner*—J. R. Scott

*Attorney, Agent, or Firm*—Anthony J. Casella; Gerald E. Hespos; Ludomir A. Budzyn

[57] ABSTRACT

A slidable element is provided for easy positioning in a guide slot when a handle is withdrawn. A handle 40 is inclinably provided on a mount body 35 bearing a movable electrode 31 by a support shaft 45. The support shaft 45 is loosely movable with respect to the mount body 35 by being fixed to the handle 40 and being inserted through oblong holes 42 formed in bearing portions 41 of the mount body 35. In order to withdraw the handle 40, it is necessary to position slidable projections 70 at the bottom ends of linear portions 75 of guide slots 74 while the handle 40 is pulled up. Since the support shaft 45 is movable upward within the oblong holes 42, the handle 40 can singly be pulled up while the movable electrode 31 is still engaged with the fixed electrodes 11*a*, 11*b*. During this time, the slidable projections 70 can be positioned and passed through the linear portions 75 of the guide slots 74 with a small force.

17 Claims, 9 Drawing Sheets

BREAKER DEVICE

BACKGROUND OF THE INVENTION

1. Field of the Invention

The present invention relates to a breaker device disposed in a power line supply circuit of, e.g. an electric automotive vehicle.

2. Description of the Prior Art

In a power line of an electric automotive vehicle, it is referred that a breaker for interrupting the power line for maintenance or for other reason be disposed together with a fuse for preventing a flow of an excessively large current. Accordingly, a knife switch type breaker and a container for housing the fuse have conventionally been disposed in the power line while being connected in series.

However, since a large current flows in the power line of the electric automotive vehicle, it is necessary to make both the knife-switch type breaker and the fuse container large, necessitating a large space to dispose them. Furthermore it is difficult to disengage the knife-type breaker to interrupt the current.

The breaker device according to the invention was developed in view of the above problem, and an object thereof is to provide a compact breaker device, which allows for an easy interruption of the current.

SUMMARY OF THE INVENTION

According to the invention there is provided a breaker device comprising a pair of fixed electrodes provided in a casing. A movable electrode is provided for disconnecting and/or connecting the fixed electrodes by being engaged with and/or disengaged from the fixed electrodes. A handle is provided at the movable electrode for the engagement and disengagement of the movable electrode with and from the fixed electrodes. The handle is loosely movably provided with respect to the movable electrode along directions of engagement and disengagement of the movable electrode.

According to the invention a wobbling of the handle during the disengagement of the movable electrode can be prevented thereby rendering the disengagement of the movable electrode easier. Furthermore the handle can be more easily positioned and an "inertial effect", which also facilitates the disengagement of the handle, is achieved, since the handle can be loosely or easily moved in a direction of engagement or disengagement of the movable electrode before the movable electrode is actually disengaged. Therefore the handle produces inertial forces that contribute to the actual disengagement forces which occur when the disengagement resistance of the fixed/movable electrodes act. In other words the handle can be accelerated before encountering the disengagement resistance of the fixed/movable electrodes via the movable electrode.

According to a preferred embodiment of the invention, the handle is made loosely movable by fitting a shaft of inclination or pivotal movement fixed to either one of the handle and the movable electrode into an oblong hole formed in the other one of the handle and the movable electrode. Thus particularly by providing oblong bearing holes, the handle is allowed to be pivotably and linearly moved with respect to the movable electrode means.

Preferably, the breaker device further comprises an elastic holding means between the handle and the movable electrode for preventing the handle and/or the movable electrode from wobbling. The elastic holding means may act on a shaft fixed to either one of the handle and the movable electrode. The shaft preferably has a substantially rectangular cross section.

According to a further preferred embodiment of invention, the breaker device comprises a slidable element and a guide slot between the handle and the casing. The guide slot is adapted to guide a relative sliding movement of the slidable element as the handle is operated to engage and/or disengage the movable electrode with and/or from the fixed electrodes.

Preferably, the handle is inclinably provided at the movable electrode.

The breaker may further comprise an inclination or pivotal movement permitting portion formed at a guide slot for permitting the handle to be inclined or pivoted by permitting the relative displacement or pivotal movement of the slidable element upon substantially attaining the proper engagement of the movable electrode with the fixed electrodes.

A length of the slidable element along a direction of insertion of the slidable element into the guide slot may be substantially larger than a width of the guide slot in a direction at an angle different from 0° or 180° with respect to the direction of insertion of the slidable element, and in particular along a direction of inclination of the handle in its resting position.

According to still a further preferred embodiment, the handle comprises first and second handle elements that are displaceable with respect to each other. The first and second handle elements preferably are engaged telescopically with each other. Telescopic movement of one handle element may be restricted in an expansion or elongation direction and/or in a contraction direction by providing telescopic movement restricting means. By providing telescopically engaged handle elements a movement of one handle element can be performed, thereby allowing for the above mentioned inertial effect thus facilitating a disengagement of the movable electrode. The telescopic movement restricting means may comprise at least two projections being provided on the first and/or second handle element. The two projections may interact with each other to restrict the telescopic movement of one handle element.

According to a preferred embodiment of the invention, there is provided a breaker device which comprises a pair of fixed electrodes provided in a casing. A movable electrode is provided for disconnecting and/or connecting the fixed electrodes by being engaged with and disengaged from the fixed electrodes. A handle is provided inclinably at the movable electrode for the engagement and disengagement of the movable electrode with and from the fixed electrodes. A slidable element and a guide slot are provided between the handle and the casing. The guide slot is adapted to guide a relative sliding movement of the slidable element as the handle is operated to engage and disengage the movable electrode with and from the fixed electrodes. An inclination permitting portion is formed at the guide slot for permitting the handle to be inclined by permitting the relative displacement of the slidable element upon attaining the proper engagement of the movable electrode with the fixed electrodes. With this construction, the handle is loosely movably provided with respect to the movable electrode along directions of engagement and disengagement of the movable electrode.

When the movable electrode is to be disengaged, the handle is raised from the resting position and pulled up while the slidable element is so positioned as to face the guide slot. In this case, since the handle is loosely movable with respect to the movable electrode, it can singly be pulled up with the fixed electrodes and the movable electrode engaged with each other. Accordingly, the slidable element can be positioned with a small force. Upon the completion of positioning, the handle may be pulled up against the frictional force acting between the electrodes while the slidable element passes the guide slot.

In other words, according to the invention, the slidable element can easily be positioned with respect to the guide slot prior to the withdrawal of the handle.

Preferably, the handle is made loosely movable by fitting a shaft of inclination or pivotal movement fixed to either one of the handle and the movable electrode into an oblong hole formed in the other one of the handle and the movable electrode.

By relatively moving the shaft of inclination within the oblong hole, the loose movement of the handle with respect to the movable electrode is permitted.

According to a further preferred embodiment, there is further provided an elastic holding means provided between the handle and the movable electrode for preventing the handle and/or the movable electrode from wobbling.

Since the wobble of the handle and the movable electrode with respect to each other is prevented, the insertion can smoothly be performed.

These and other objects, features and advantages of the present invention will become more apparent upon a reading of the following detailed description and accompanying drawings.

DETAILED DESCRIPTION OF THE PREFERRED EMBODIMENTS

Figure 1:
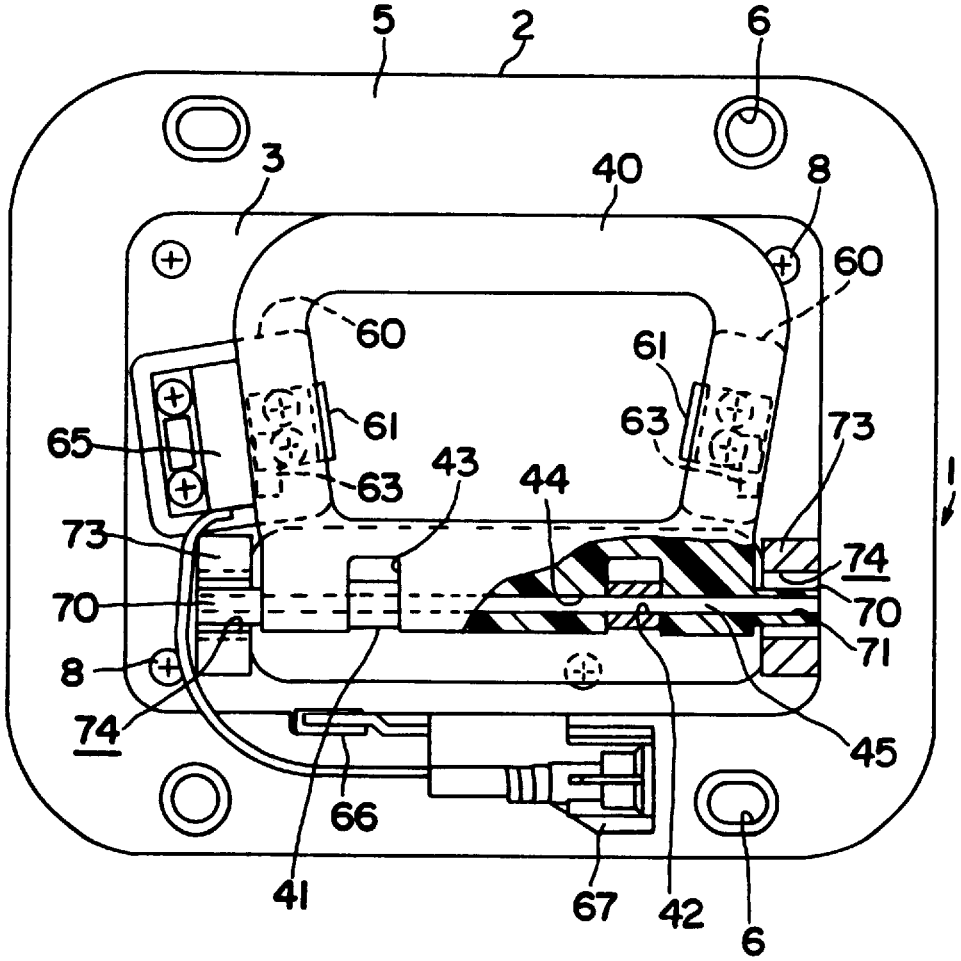
FIG. 1 a plan view partly in section of a first embodiment of the invention when a handle is in its resting position.
Figure 2:
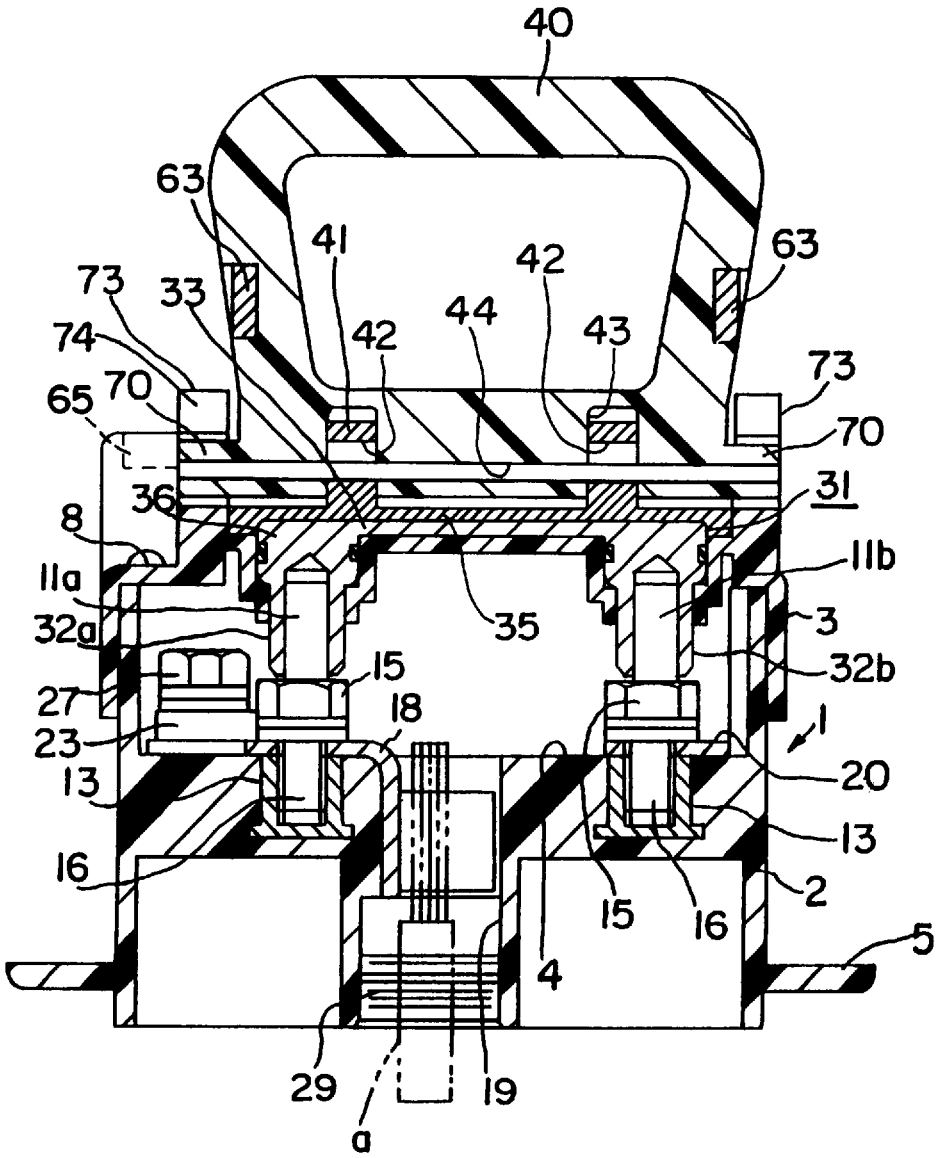
FIG. 2 is a vertical section of the first embodiment when the handle is in its standing position.
Figure 3:
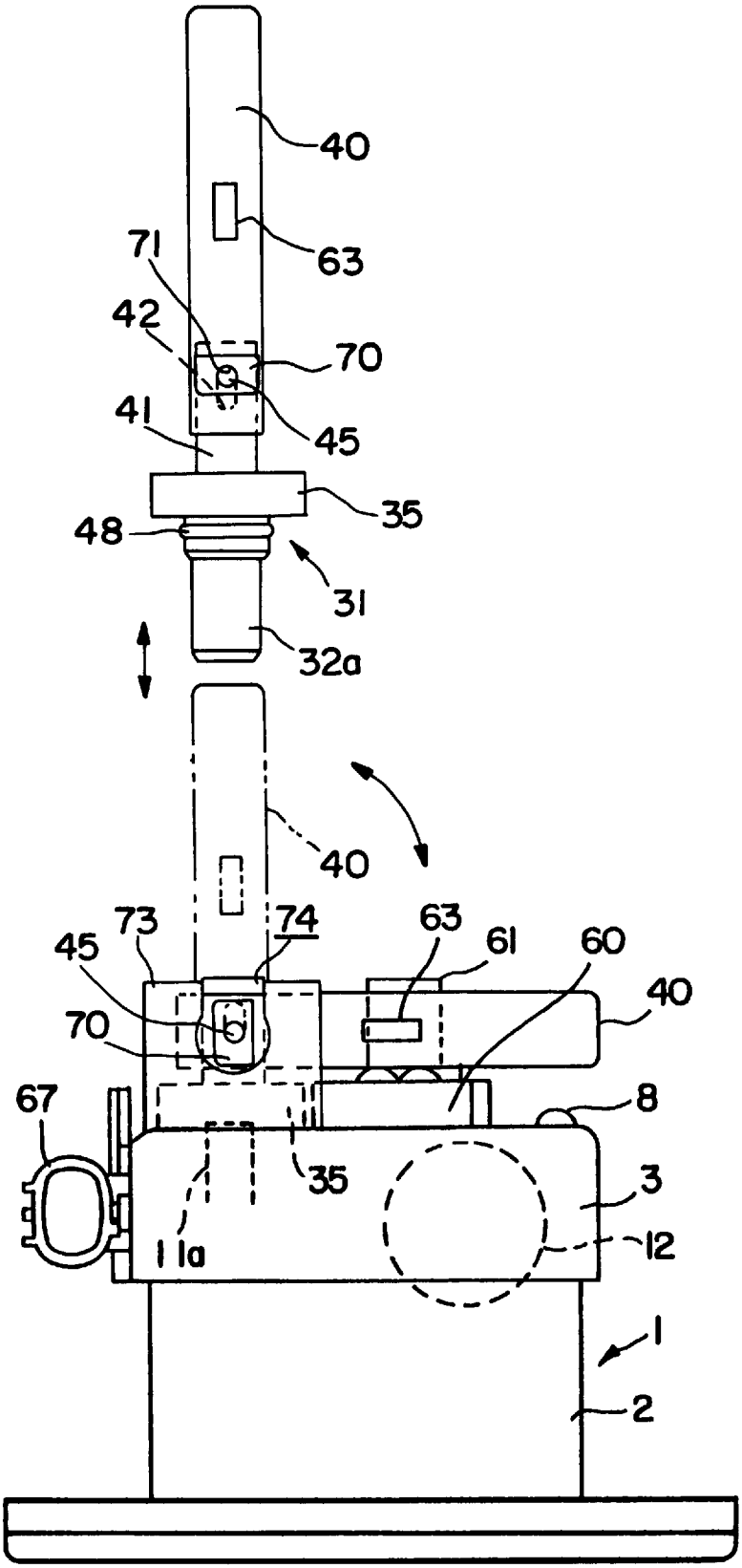
FIG. 3 is a side view showing how the handle is used for the engagement an disengagement of electrodes.

FIGS. 1 to 11 show a first embodiment of the invention. In FIGS. 1 to 3, a casing 1 made of e.g. synthetic resin includes upper and lower casings 2 and 3. The lower casing 2 is in the form of a bottomed tube having a substantially rectangular cross section, and its bottom wall 4 is located substantially in the middle of its height. Further, a mount flange 5 is formed around the outer surface of the bottom end of the lower casing 2. This flange 5 is mounted on an unillustrated vehicle body by fastening screws through mount holes 6 formed in its four corners.

The upper casing 3 is formed into a lid-like shape to be fitted to the upper end of the lower casing 2. The upper casing 3 is detachably fitted to the lower casing 2 by fastening screws 8 inserted through insertion holes formed in four corners of its upper surface into screw holes formed in four corners of the upper end surface of the lower casing 2.

In the lower casing 2, a pair of fixed electrodes 11*a*, 11*b* are placed upright at one side (front side in FIG. 4), and a fuse 12 is accommodated at the other side. In order to stand the fixed electrodes 11*a*, 11*b*, a pair of internally threaded members 13 are buried in the bottom wall 4 at a specified interval e.g. by insert molding as shown in FIG. 2. Each of the fixed electrodes 11*a*, 11*b* is preferably in the form of a pin, and formed with a hexagonal portion 15 in its longitudinal center and with an externally threaded portion 16 at its bottom end. In other words, the respective electrodes 11*a*, 11*b* can stand by spirally fitting the externally threaded portions 16 with the corresponding internally threaded members 13.

Figure 4:
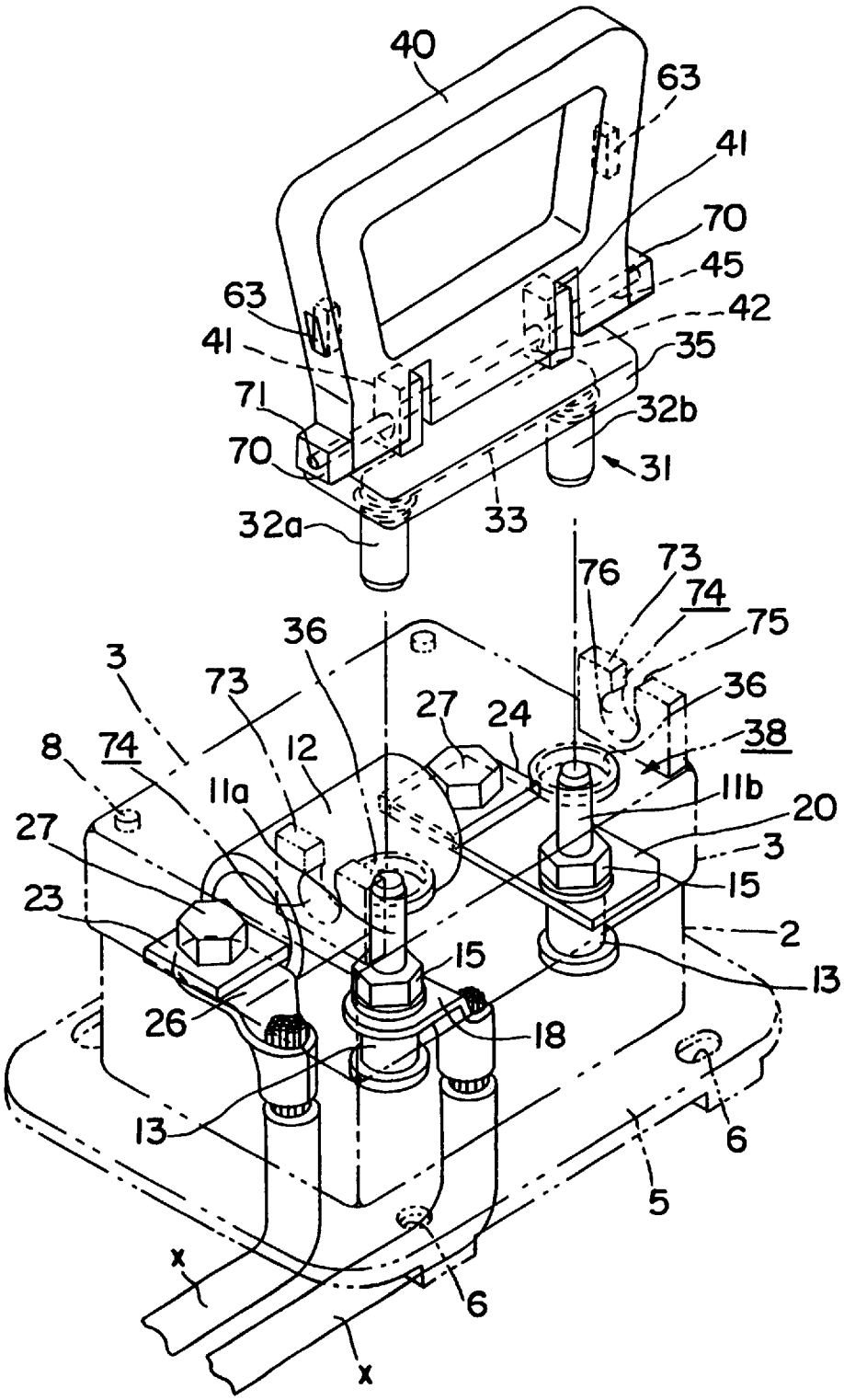
FIG. 4 is a perspective view showing the interior construction of a casing and the construction of a mount body.

As also shown in FIG. 4, a terminal fitting 18 connected with one cut end of a wire x is secured to one fixed electrode 11*a* (left one in FIG. 2). This part of the wire x is drawn out through a first insertion hole 19 formed in the bottom wall 4. Further, a busbar 20 connected with one end of the fuse 12 to be described later is secured to the other fixed electrode 11*b*.

The fuse 12 is accommodated at the other side of the bottom wall 4 of the lower casing 2. Connection members 23, 24 project from the opposite ends of the fuse 12. One connection member 23 is secured to the terminal fitting 26 connected with the other cut end of the wire x by fastening a bolt 27. This part of the wire x is drawn through a second insertion hole (not shown) similar to the above insertion hole 19 formed in the bottom wall 4. Waterproof plugs 29 mounted on the wire x are fitted into the insertion holes 19, 28 to seal the openings. To the other connection member 24 of the fuse 12 is secured one end of the horizontally extending busbar 20 by another bolt 27 (FIG. 2). The other end of the busbar 20 is secured to the fixed electrode 11*b* as described above.

Figure 6:
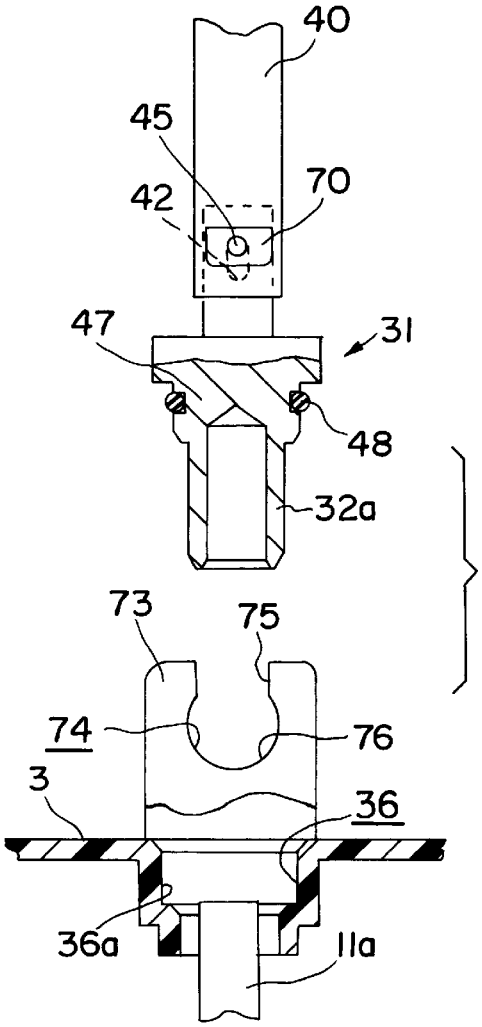
FIG. 6 is a partial side view showing a state before the handle is inserted.

A movable electrode 31 is detachably engageable with the pair of fixed electrodes 11*a*, 11*b*. As shown in FIG. 2, the movable electrode 31 is constructed such that a bridging member 33 is bridged between a pair of louver terminals 32*a*, 32*b* engageable with the leading ends of the respective fixed electrodes 11*a*, 11*b* so as to connect the louver terminals 32*a*, 32*b*. The movable electrode 31 is formed by mounting the respective louver terminals 32*a*, 32*b* on a narrow mount body 35 e.g. of synthetic resin preferably by insert molding such that the louver terminals 32*a*, 32*b* project from the bottom surface of the mount body 35. As shown in FIG. 6, the base ends of the louver terminals 32*a*, 32*b* have a larger diameter, i.e. are formed with a large diameter portion 47 and seal rings 48 are fitted on the outer surfaces of large diameter portions 47.

On the other hand, a pair of insertion holes 36 into which the louver terminals 32*a*, 32*b* of the movable electrode 31 are insertable are formed in positions of the ceiling wall of the upper casing 3 right above the fixed electrodes 11*a,* 11*b.* The insertion holes 36 are each widened in a position corresponding to the large diameter portion 47 of the louver terminal 32*a* or 32*b,* thereby forming a large diameter portion 36*a.* More specifically, the louver terminals 32*a,* 32*b* of the movable electrode 31 are engaged with and disengaged from the corresponding fixed electrodes 11*a,* 11*b* within the casing 1 through the insertion holes 36, thereby forming a breaker switch 38 for connecting and disconnecting the fixed electrodes 11*a,* 11*b.* Clearances between the louver terminals 32*a,* 32*b* and the corresponding insertion holes 36 are sealed by the seal rings 48. The fuse 12 is disposed in an intermediate position of the wire x while being connected in series with the breaker switch 38.

Figure 5:
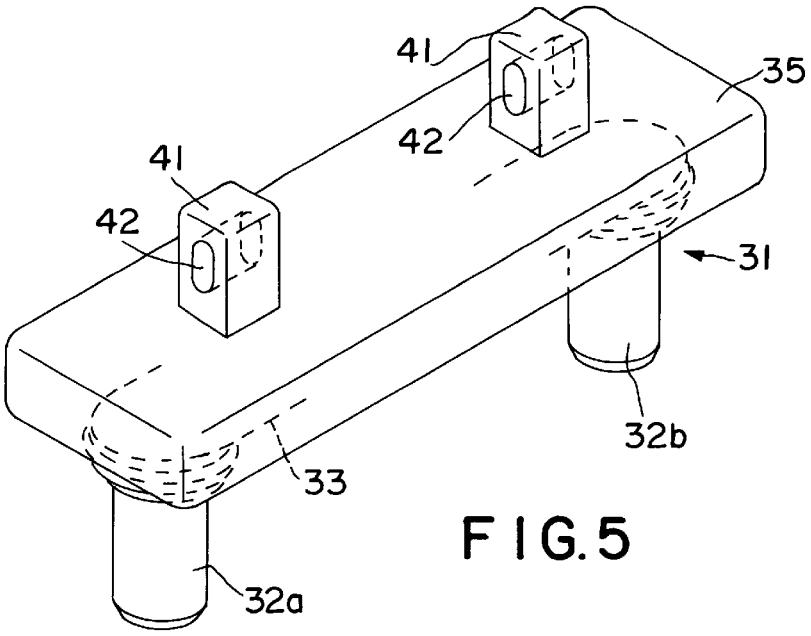
FIG. 5 is an enlarged perspective view of a mount body.

A handle 40 used to engage and disengage the movable electrode 31 is provided at the upper surface of the mount body 35. The handle 40 is preferably in the form of a frame having an outer shape of substantially an inverted trapezoid. Bearing portions 41 project at the opposite ends of the upper surface of the mount body 35 with respect to its longitudinal direction. Further, a pair of engaging recesses 43 engageable with the bearing portions 41 are formed at the edge of the mount side of the handle 40. A bearing hole 44 is so formed at the mount edge of the handle 40 as to extend through the engaging recesses 43 and open in the opposite end surfaces. On the other hand, each bearing portion 41 of the mount body 35 is formed with an oblong hole 42 having a vertically long cross section as shown in FIG. 5.

The bearing portions 41 of the mount body 35 are fitted or inserted into the engaging recesses 43 of the handle 40. By inserting a support shaft 45 through the bearing hole 44 and the oblong holes 42, the handle 40 is mounted on the upper surface of the mount body 35, pivotally about the support shaft 45. The handle 40 is also movable toward and away, in particular upward and downward with respect to the mount body 35 by relatively moving the support shaft 45 within the oblong holes 42.

Further, on the opposite outer surfaces of the handle 40 where the support shaft 45 is inserted, preferably rectangular or cube-shaped slidable projections 70 are so formed as to project by a specified distance as shown in FIG. 6. In each slidable projection 70, an insertion hole 71 for the support shaft 45 is so formed as to be substantially coaxial with the bearing hole 44.

On the other hand, a guide column 73 stands at each of left and right sides of the upper surface of the upper casing 3 where the handle 40 is inserted. Each guide column 73 is formed with a guide slot 74 for guiding the slidable projection 70 while the handle 40 is inserted. The guide slot 74 is open in a direction of insertion/withdrawal of the louver terminals 32*a,* 32*b,* in particular upward and substantially extends along the vertical direction as shown in FIG. 6. A substantially linear portion 75 acting as a rotation restricting portion in which the slidable projection 70 is unrotatably and freely slidably fittable is formed at an upper part of each guide slot 74, and a rotation permitting portion 76 having preferably a substantially circular shape whose diameter is larger than the width of the linear portion 75 so as to permit the rotation of the slidable projection 70 about the support shaft 45 is formed at a lower part thereof.

When the movable electrode 31 starts fitting to the fixed electrodes 11*a,* 11*b* while the handle 40 is being inserted, the movable electrode 31 is subjected to a fitting resistance and the handle 40 moves closer to the mount body 35 to press the mount body 35. In the meantime, the slidable projections 70 start entering the linear portions 75.

When the insertion of the handle 40 is completed by properly engaging the movable electrode 31 with the fixed electrodes 11*a,* 11*b,* the slidable projections 70 reach the rotation permitting portions 76.

In positions of the ceiling surface of the upper casing 3 corresponding to the accommodated fuse 12, support tables 60 are provided as shown in FIGS. 1 and 3. A substantially L-shaped receiving member 61 is mounted on each support table 60. The receiving members 61 receive the substantially center portions of the opposite side portions of the handle 40 when the movable electrode 31 is properly engaged with the fixed electrodes 11*a,* 11*b* and the handle 40 is inclined to its resting position.

Magnets 63 are mounted in preferably symmetrical positions of the outer surfaces of the opposite side portions of the hand 40. On the other hand, a lead switch 65 is mounted on the ceiling surface of the upper casing 3. The lead switch 65 is so disposed as to be located right before one of the magnets 63 when the movable electrode 31 is properly engaged with the fixed electrodes 11*a,* 11*b* and the handle 40 is inclined to its resisting position as described above, and outputs a detection signal when the magnet 63 comes right before it. The lead switch 65 is connected with an unillustrated computer for performing necessary controls via a connector 67 mounted by a bracket 66 at one side surface of the upper casing 3.

The first embodiment is constructed as described above, and the operation thereof is described hereafter. The pair of fixed electrodes 11*a,* 11*b* are placed upright and the fuse 12 is accommodated in the casing 1, and connected in a manner as described above between the cut ends of the wire x. In order to bring the wire x into its conductive state, the handle 40 is raised to its standing position outside the casing 1 as shown in FIG. 6 and gripped to insert the louver terminals 32*a,* 32*b* of the movable electrode 31 projecting from the mount body 35 into the insertion holes 36 formed in the upper casing 3.

Figure 7:
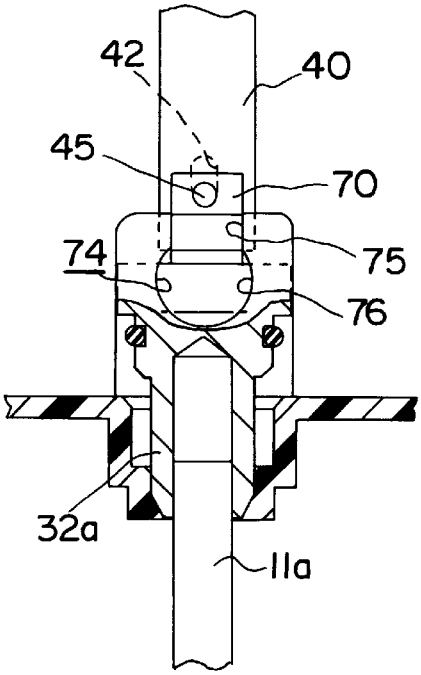
FIG. 7 is a partial side view showing the engagement of the electrodes.
Figure 8:
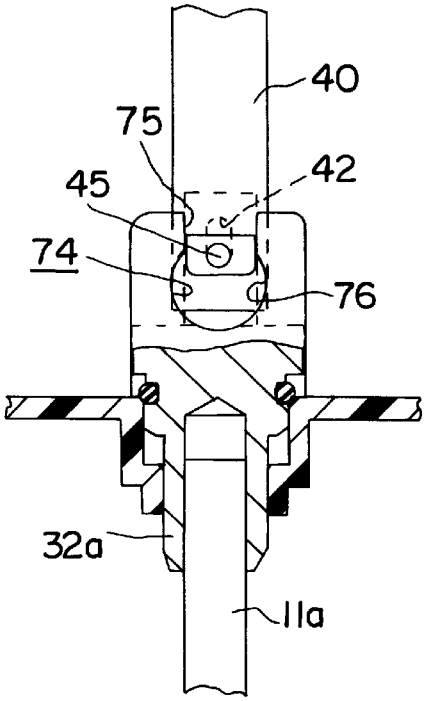
FIG. 8 is a partial side view showing a state during the insertion of the handle.

When the louver terminals 32*a,* 32*b* start fitting to the corresponding fixed electrodes 11*a,* 11*b,* the handle 40 is subjected to a fitting resistance. Accordingly, the handle 40 moves closer to the mount body 35 while the support shaft 45 moves downward within the oblong holes 42 as shown in FIG. 7. In this state, the mount body 35 is pressed. In the meantime, the slidable projections 70 provided at the handle 40 enter the linear portions 75 of the guide slots 74 as shown in FIG. 8. Since the rotation of the slidable projections 70 are prevented in the linear portions 75, the handle 40 is pushed in straight without wobbling, smoothly fitting the louver terminals 32*a,* 32*b* to the fixed electrodes 11*a,* 11*b.* Thereby, the breaker switch 38 is turned on to bring the wire x into an electrically conductive state via the fuse 12.

Figure 9:
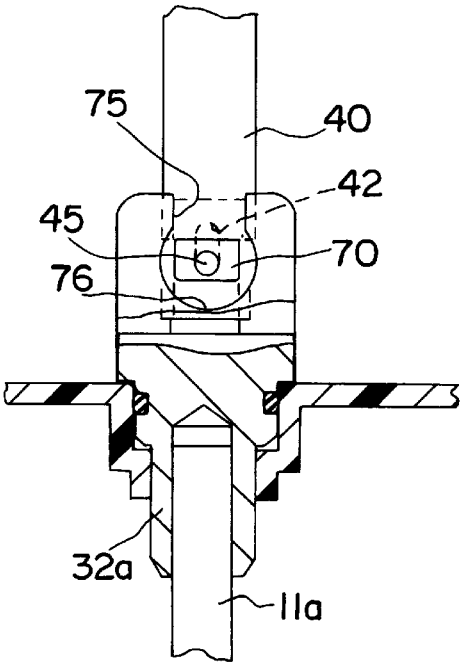
FIG. 9 is a partial side view showing a state after the insertion of the handle is completed.

Here, if the louver terminals 32*a,* 32*b* of the movable electrode 31 are properly engaged with the corresponding fixed electrodes 11*a,* 11*b,* the slidable projections 70 move beyond the linear portions 75 of the guide slots 74, reaching the rotation permitting portions 76 as shown in FIG. 9. Since the slidable projections 70 are permitted to rotate or pivot about the support shaft 45, the handle 40 standing upright can be inclined to the resting position as shown in FIG. 10.

On the other hand, in an insufficiently engaged state where the louver terminals 32*a,* 32*b* of the movable electrode 31 are not properly engaged with the fixed electrodes 11*a,* 11*b,* the slidable projections 70 are still in the linear portions 75 as shown in FIG. 8 and, accordingly, cannot rotate. Thus, the handle 40 cannot be inclined. The insufficiently engaged state can be detected in this manner. In such a case, the handle 40 is pushed again to its proper position.

Since the slidable projection 70 and the guide slot 74 are provided at both left and right sides, the same action as above can be expected even if the handle 40 is inserted after being rotated 180° on a horizontal plane. Further, if the handle 40 is inclined to the resting position after the movable electrode 31 is properly fitted to the fixed electrodes 11*a,* 11*b* as described above, one of the magnets 63 provided at the handle 40 is located right before the lead switch 65. Accordingly, the lead switch 65 outputs the detection signal, thereby electrically detecting that the breaker switch 38 has been turned on.

Figure 10:
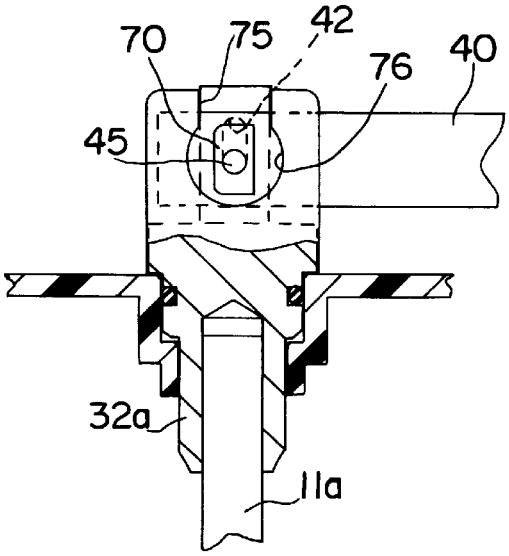
FIG. 10 is a partial side view showing a state where the handle is in its resting position.
Figure 11:
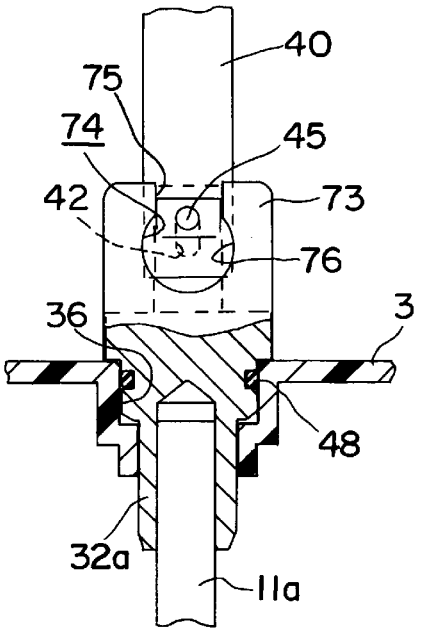
FIG. 11 is a partial side view showing a state at the start of the withdrawal of the handle.

When the breaker switch 38 is turned off for the maintenance, the handle 40 is raised to the standing position from the resting position indicated by solid line in FIG. 3 and in FIG. 10. In this case, the slidable projections 70 need to be positioned at the bottom ends of the linear portions 75 of the guide slots 74 while the handle 40 is pulled up. Since the support shaft 45 is movable upward within the oblong holes 42, the handle 40 can singly be pulled up while the movable electrode 31 is still engaged with the fixed electrodes 11*a,* 11*b*. During this time, with a small force, the slidable projections 70 can be positioned and caused to pass the guide slots 74 as shown in FIG. 11. Thereafter, the handle 40 may be withdrawn against a frictional force acting between the fixed electrodes 11*a,* 11*b* and the movable electrode 31 while the slidable projections 70 are passed through the linear portions 75. As a result, the movable electrode 31 is disengaged from the fixed electrodes 11*a,* 11*b* and the breaker switch 38 is turned off, bringing the wire x into a nonconductive state.

Further, when the fuse 12 blows out, the breaker switch 38 is turned off by withdrawing the movable electrode 31 in the similar manner as above, and the screws 8 are loosened to remove the upper casing 3. Since the fuse 12 is exposed in this state, the fuse 12 is removed by loosening the bolts 27 and replaced with a new one. Because the breaker switch 38 is already turned off, the fuse 12 can be safely exchanged.

As described above, according to the breaker device of this embodiment, the positioning of the slidable projections 70 with respect to the linear portions 75 of the guide slots 74 prior to the withdrawal of the handle 40 can easily be performed with a small force.

Figure 12:
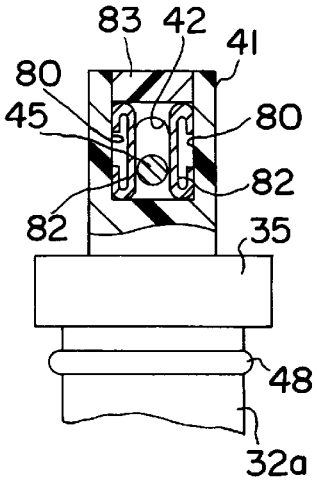
FIG. 12 is a vertical section of a construction for bearing a support shaft according to a second embodiment.
Figure 13:
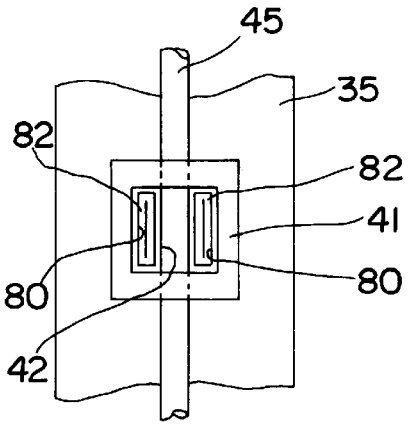
FIG. 13 is a plan view with a lid plate detached.

FIGS. 12 and 13 show a second embodiment of the invention. The second embodiment is provided with a means for preventing the handle 40 from wobbling at the start of the insertion of the movable electrode 31.

Specifically, in each bearing portion 41 provided at the mount body 35, mount holes 80 are formed at the opposite sides of the oblong hole 42. Leaf springs 82 are mounted in the mount holes 80 to elastically hold the support shaft 45. The upper end of the mount holes 80 are closed by a lid plate 83. On the other hand, at the start of the withdrawal of the handle 40, the support shaft 45 needs to relatively easily move along the oblong holes 42 in order to position the slidable projections 70 as described above. Accordingly, the holding force of the leaf springs 82 needs to be set sufficiently smaller than a frictional force which will act between the fixed electrodes 11*a,* 11*b* and the movable electrode 31.

Since the other construction is similar to the first embodiment, no repetitive description is given thereon by identifying elements having the same function by the same reference numerals.

According to the second embodiment, by holding the support shaft 45 by the leaf springs 82, the handle 40 can be so securely held in its standing position with respect to the mount body 35 that it does not wobble. Accordingly, when the handle 40 is gripped to insert the louver terminals 32*a,* 32*b* of the movable electrode 31 into the insertion holes 36, the mount body 35 or the movable electrode 31 does not wobble, with the result that the louver terminals 32*a,* 32*b* can smoothly be inserted into the insertion holes 36. The inclination of the handle 40 can also prevented until the slidable projections 70 are fitted into the guide slots 74.

When the handle 40 is to be withdrawn, it can singly be pulled up with the movable electrode 31 engaged with the fixed electrodes 11*a,* 11*b* while the support shaft 45 moves along the oblong holes 42 against the holding forces of the leaf springs 82. During this time, the slidable projections 70 can be positioned.

Figure 14:
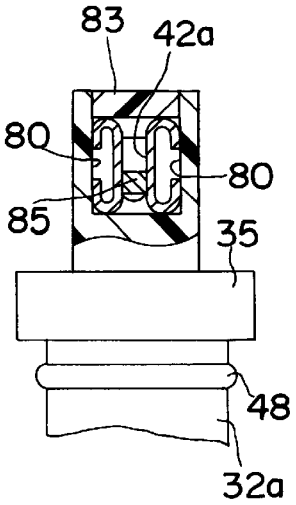
FIG. 14 is a vertical section of a construction for bearing a support shaft according to a third embodiment.

FIG. 14 shows a third embodiment of the invention. In the third embodiment, a support shaft 85 for inclinably supporting the handle 40 is constructed by a substantially rectangular bar and is held by pairs of leaf springs 82 as in the second embodiment. The support shaft 85 needs to be rotatable within oblong holes 86.

Since the support shaft 85 is a substantially rectangular bar, the leaf springs 82 hold the support shaft 85 while being in contact therewith over wide areas of the opposite surfaces of the support shaft 85. Accordingly, the wobble of the handle 40 with respect to the mount body 35 can more effectively be prevented.

Figure 15:
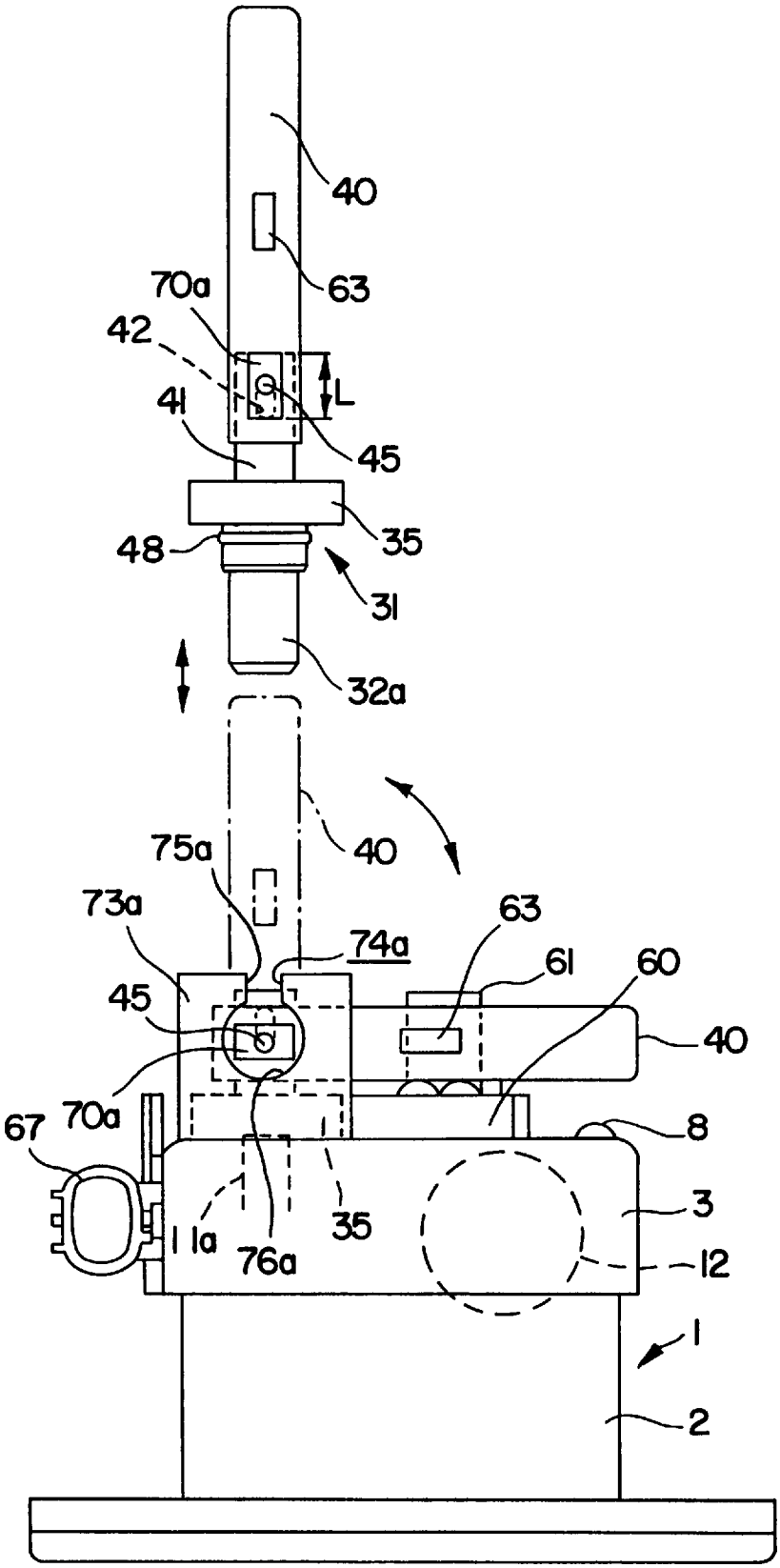
FIG. 15 is a side view showing how the handle is used for the engagement and disengagement of electrodes according to a fourth embodiment.

FIG. 15 shows a fourth embodiment of the invention. In the fourth embodiment, slidable projections 70*a* are so formed as to extend long along the vertical direction when the handle 40 is in its standing position. On the other hand, a guide slot 74*a* formed in each guide column 73*a* includes a substantially linear portion 75*a* acting as a rotation preventing means in which the vertically oriented slidable projection 70*a* is so fitted or inserted that it is only free to make a sliding movement and a rotation permitting portion 76*a* for permitting the rotation of the slidable projection 70*a* about the support shaft 45.

According to the fourth embodiment, during the insertion of the handle 40, the slidable projections 70*a* are fitted into the linear portions 75*a* of the guide slots 74*a,* thereby preventing the rotation of the handle 40. Accordingly, the handle 40 can be pressed in straight without wobbling. If the movable electrode 31 is properly engaged with the fixed electrodes 11*a,* 11*b,* the slidable projections 70*a* reach the rotation permitting portions 76*a* of the guide slots 74*a,* where the handle 40 is permitted to be inclined by permitting the rotation of the slidable projections 70*a* about the support shaft 45. Further, prior to the withdrawal of the handle 40, the slidable projections 70*a* can be positioned with respect to the linear portions 75*a* of the guide slots 74*a* with a small force.

Particularly, the fourth embodiment is constructed such that, when the handle 40 is inclined, the slidable projections 70*a* are horizontally oriented, thereby getting caught by the linear portions 75*a* of the guide slots 74*a*. This construction acts to prevent the handle 40 or the movable electrode 31 from being disengaged from the fixed electrodes 11*a,* 11*b,* in particular when the handle 40 is in its inclined position.

Figure 16:
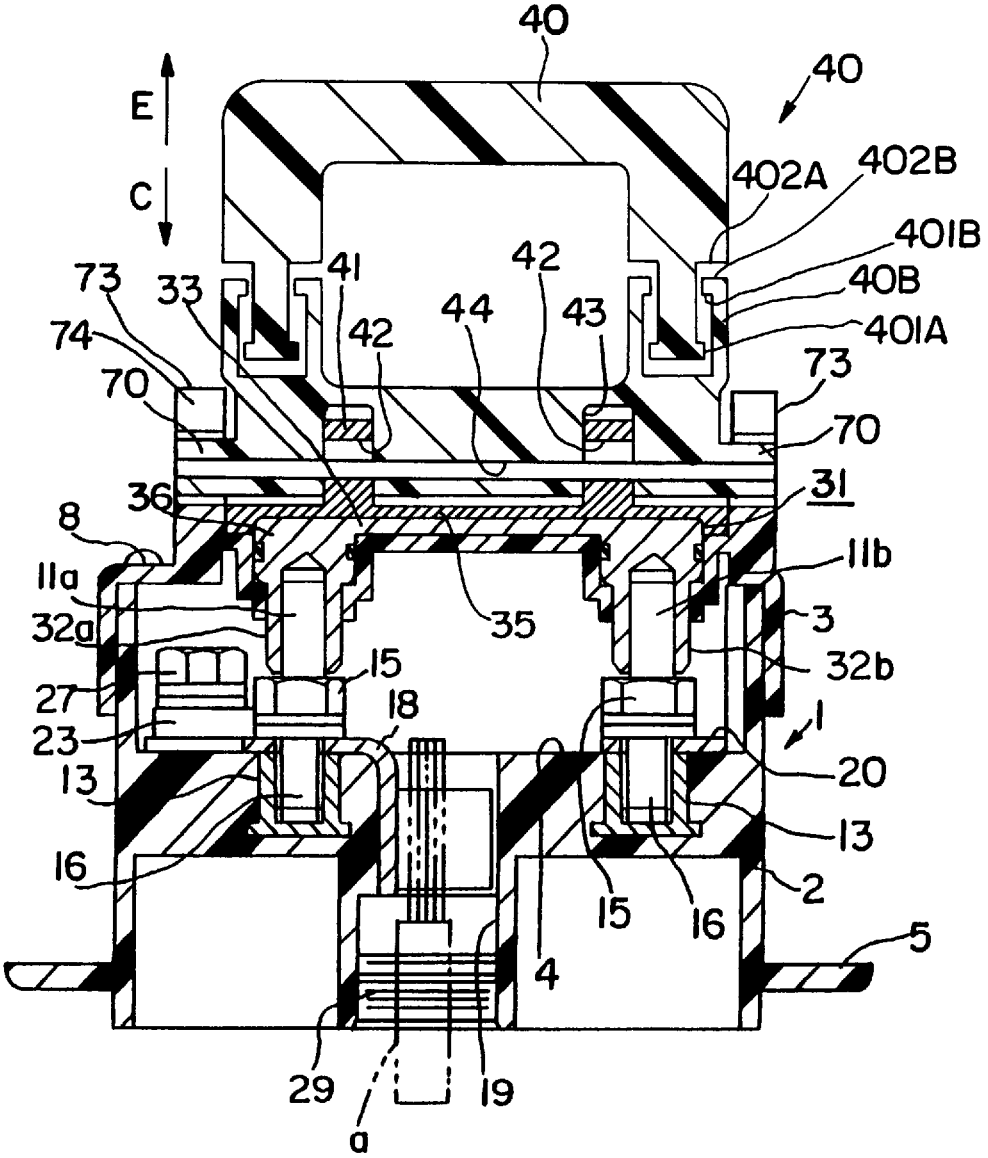
FIG. 16 is a vertical section of a fifth embodiment when the handle is in its standing position.

FIG. 16 shows a fifth embodiment of the invention. The fifth embodiment is provided with a handle 40 comprising two handle elements 40A and 40B.

Specifically the handle 40 is provided with two handle elements being telescopically arranged, i.e. being engaged such with each other, that e.g. the handle element 40A can be expanded or elongated away from the other handle element 40B. The handle element 40A is provided with at least one projection 401A which can interact with or abut on a projection 401B of the handle element 40B, thereby restricting the movement of the handle element 40A in an elongation or expansion direction E. Furthermore the handle element 40A comprises at least one projection 402A (or recess), which can interact with or abut on a projection 402B of the handle element 40B, thereby restricting the telescopic movement of the handle element in a contraction direction C.

The present invention is not limited to the foregoing embodiment described above and shown in the drawings. For example, the following embodiment is embraced by the technical scope of the present invention as defined in the claims, and a variety of other changes are possible without departing from the spirit and scope of the present invention as defined in the claims besides the following embodiment.

As a means for permitting a loose movement of the handle 40, opposite to the foregoing embodiments, the bearing hole 44 may be so formed as to have an oblong cross section.

The slidable projections may be provided at the fixed casing 1, whereas the guide slots may be provided at the movable handle 40. The present invention is similarly applicable to such a construction.

The invention is not limited to the breaker device where the fuse is provided at the side of the breaker switch, but also applicable to a breaker device singly including a breaker switch.

What is claimed is:

1. A breaker device comprising:

a pair of substantially parallel fixed electrodes provided in a casing, a movable electrode having a pair of substantially parallel terminal portions, said terminal portions being dimensioned and disposed for substantially simultaneous connection with the fixed electrodes by moving the movable electrode toward the casing and parallel to said fixed electrodes, said terminal portions further being substantially simultaneously disconnectable from said fixed electrodes by moving said movable electrode away from said casing in a direction substantially parallel to the fixed electrodes, and a handle for selectively moving the terminal portions of the movable electrode into and out of engagement with the fixed electrodes, wherein the handle is mounted to the movable electrode for rotation about an axis orthogonal to said terminal portions of said movable electrode and for linear translation relative to said movable electrode along directions parallel to the terminal portions of the movable electrode wherein the translation of said handle relative to said movable electrode produces inertial forces for overcoming disengagement resistance between said movable electrode and said fixed electrodes.

2. A breaker device according to claim 1, wherein the handle is linearly movable relative to the movable electrode by fitting a shaft of inclination fixed to a selected one of the handle and the movable electrode into an oblong hole formed in the other one of the handle and the movable electrode, said oblong hold having a long axis aligned parallel to said fixed electrodes when said movable and fixed electrodes are engaged.

3. A breaker device according to claim 2, further comprising an elastic holding means provided between the handle and the movable electrode for preventing relative wobbling between the handle and the movable electrode.

4. A breaker device according to claim 3, wherein the elastic holding means acts on a shaft fixed to a selected one of the handle and the movable electrode, the shaft having a substantially rectangular cross section.

5. A breaker device according to claim 2, further comprising a slidable element on a selected one of the handle and the casing and a guide slot on the other of the handle and the casing, the guide slot being configured and aligned for permitting a relative sliding movement of the slidable element into the guide slot as the handle is operated to selectively engage and disengage the movable electrode with and from the fixed electrodes.

6. A breaker device according to claim 5, wherein the guide slot further comprises a narrow entry for slidably receiving the slidable element and preventing relative rotation between the handle and the casing, the guide slot further being formed with a wide inclination permitting portion for permitting the handle to be rotated about the axis and relative to the movable electrode and the casing upon substantially attaining proper engagement of the movable electrode with the fixed electrodes.

7. A breaker device according to claim 6, wherein a length of the slidable element along a direction of insertion of the slidable element into the guide slot is substantially larger than a width of the narrow entry to the guide slot for preventing rotation of the handle in the narrow portions of the guide slot.

8. A breaker device according to claim 1, wherein the handle comprises first and second handle elements displaceable with respect to each other and telescopically engaged with each other, wherein the telescopic movement of one handle element is restricted in an expansion direction (E) and in a contraction direction (C) by means for restricting telescopic movement.

9. A breaker device according to claim 8, wherein the telescopic movement restricting means comprises at least two projections on at least one of the first and second handle elements, wherein the two projections interact with each other to restrict the telescopic movement of one handle element.

10. A breaker device comprising:

a casing;

a pair of substantially parallel fixed electrodes provided in the casing;

a movable electrode having a pair of substantially parallel terminal portions, said terminal portions being dimensioned and disposed for substantially simultaneous connection with the fixed electrodes by moving the movable electrode toward the casing and parallel to said fixed electrodes, said terminal portions further being substantially simultaneously disconnectable from said fixed electrodes by moving said movable electrode away from said casing in a direction substantially parallel to the fixed electrodes;

a handle mounted to the movable electrode for rotation about an axis orthogonal to the terminal portions of said movable electrode and for translation relative to the movable electrode in directions parallel to the terminal portions;

at least one slidable element formed on a selected one of the handle and the casing and a guide slot defined on the other of the handle and the casing, the guide slot being configured and aligned for permitting a relative sliding movement of the slidable element into the guide slot for guiding the terminal portions of the movable electrode substantially parallel to the fixed electrodes.

11. A breaker device according to claim 10, wherein the guide slot includes a rotation-preventing entry portion dimensioned and configured for preventing relative rotation between the handle and the movable electrode during movement of the movable electrode toward and away from a complete connected condition with respect to said fixed electrodes.

12. A breaker device according to claim 11, wherein the guide slot includes a rotation enabling portion adjacent said rotation preventing entry portion, said rotation enabling portion being disposed and dimensioned to permit rotation of said handle relative to said movable electrode when said terminal portions of said movable electrode are completely engaged with the fixed electrodes.

13. A breaker device according to claim 12, wherein the slidable element is substantially rectangularly configured.

14. A breaker device according to claim 10, comprising a pair of slidable elements and a pair of guide slots.

15. A breaker device according to claim 10, wherein said at least one slidable element comprises a pair of substantially coaxially aligned slidable elements and wherein said at least one guide slot comprises a pair of guide slots disposed and aligned for engagement respectively with the slidable elements.

16. A breaker device according to claim 15, wherein the slidable elements are formed on the handle, and wherein the guide slots are formed on the casing.

17. A breaker device according to claim 16, further comprising a hinge shaft rotatably connecting the movable terminal and the handle, said shaft extending substantially centrally through said slidable elements.

* * * * *